US008348070B2

(12) United States Patent
Hopkins

(10) Patent No.: US 8,348,070 B2
(45) Date of Patent: Jan. 8, 2013

(54) DISPLAY MOUNTING APPARATUS

(76) Inventor: John Hopkins, Newington (AU)

( * ) Notice: Subject to any disclaimer, the term of this patent is extended or adjusted under 35 U.S.C. 154(b) by 0 days.

(21) Appl. No.: 13/246,777

(22) Filed: Sep. 27, 2011

(65) Prior Publication Data

US 2012/0012546 A1 Jan. 19, 2012

Related U.S. Application Data

(62) Division of application No. 11/503,374, filed on Aug. 11, 2006, now Pat. No. 8,056,739.

(51) Int. Cl.
*A47F 5/08* (2006.01)

(52) U.S. Cl. ..... 211/94.01; 248/220.21; 248/223.41; 52/36.6

(58) Field of Classification Search ..... 211/50, 211/86.01, 87.01, 94.01, 103, 106, 107, 189, 211/190, 207; 248/220.21, 220.31, 222.51, 248/222.52, 223.41, 225.11, 225.21; 52/36.5, 52/36.6, 36.4
See application file for complete search history.

(56) References Cited

U.S. PATENT DOCUMENTS

| | | | | | |
|---|---|---|---|---|---|
| 4,008,872 | A | * | 2/1977 | Thompson | 248/224.61 |
| 4,591,058 | A | * | 5/1986 | Amstutz et al. | 211/94.01 |
| 4,615,448 | A | * | 10/1986 | Johnstonbaugh | 211/94.01 |
| 4,629,076 | A | * | 12/1986 | Amstutz et al. | 211/94.01 |
| 4,817,538 | A | * | 4/1989 | Michaelsen | 108/108 |
| 4,944,416 | A | * | 7/1990 | Petersen et al. | 52/36.5 |
| 5,138,803 | A | * | 8/1992 | Grossen | 52/36.4 |
| 5,185,971 | A | * | 2/1993 | Johnson, Jr. | 52/36.6 |
| 5,412,912 | A | * | 5/1995 | Alves | 52/36.5 |
| 5,921,044 | A | * | 7/1999 | Holztrager | 52/483.1 |
| 6,065,262 | A | * | 5/2000 | Motta | 52/582.1 |
| 6,363,645 | B1 | * | 4/2002 | Hunter | 40/618 |
| 6,491,172 | B2 | * | 12/2002 | Chance et al. | 211/87.01 |
| 6,527,565 | B1 | * | 3/2003 | Johns | 439/116 |
| D477,423 | S | * | 7/2003 | Campbell et al. | D25/138 |
| 6,631,813 | B1 | * | 10/2003 | Walter et al. | 211/94.01 |
| D482,552 | S | * | 11/2003 | Campbell et al. | D6/509 |
| D486,676 | S | * | 2/2004 | Campbell et al. | D6/491 |
| 6,772,890 | B2 | * | 8/2004 | Campbell et al. | 211/94.01 |
| 6,837,384 | B2 | * | 1/2005 | Secondino | 211/87.01 |
| 7,793,450 | B2 | * | 9/2010 | Chasmer et al. | 40/657 |
| 2001/0047971 | A1 | * | 12/2001 | Chance et al. | 211/87.01 |
| 2003/0189019 | A1 | * | 10/2003 | Campbell et al. | 211/94.01 |
| 2003/0189020 | A1 | * | 10/2003 | Secondino | 211/94.01 |
| 2004/0222176 | A1 | * | 11/2004 | Campbell et al. | 211/94.01 |
| 2006/0012977 | A1 | * | 1/2006 | Joseph | 362/147 |
| 2006/0049323 | A1 | * | 3/2006 | Anzai | 248/250 |
| 2006/0091093 | A1 | * | 5/2006 | Armari | 211/94.01 |

FOREIGN PATENT DOCUMENTS

WO WO 2004/052151 * 6/2004

* cited by examiner

*Primary Examiner* — Darnell Jayne
*Assistant Examiner* — Joshua Rodden
(74) *Attorney, Agent, or Firm* — Michael Molins

(57) ABSTRACT

A display apparatus and method for mounting display brackets. The display brackets having a male anchor portion having a profile which is an upwardly curved tab of substantially even thickness. The apparatus comprising: an elongate insert element having an anterior face and posterior face; the elongate insert element having a pair of parallel longitudinal anterior lip portions that define an elongate longitudinal orientated slot aperture to a substantially horizontally orientated anchoring cavity for receiving the male anchor portion; the anchor cavity having a profile that substantially conforms to the profile of the male anchor portion.

15 Claims, 20 Drawing Sheets

DISPLAY MOUNTING APPARATUS

CLAIM OF PRIORITY

This application claims the right of priority under 35 U.S.C. §119(a) to Australian patent application number 2005203620, filed on 12 Aug. 2005, the contents of which are incorporated herein by reference. This application is a divisional application claiming a right of priority from U.S. application Ser. No. 11/503,374, now U.S. Pat. No. 8,056,739, filed on 11 Aug. 2006, the contents of which are incorporated herein by reference.

TECHNICAL FIELD

The invention relates to commercial display mounting systems, of the kind typically fitted by a specialist shopfitter. In particular, it relates to an improved construction for a panel which forms part of a display wall, and which provides a mounting for a cantilevered display support.

BACKGROUND OF THE INVENTION

Any discussion of the prior art throughout the specification should in no way be considered as an admission that such prior art is widely known or forms part of the common general knowledge in the field.

Retailers and others who display goods commonly use demountable shelving and display supports for displaying those goods.

One requirement for commercial display systems is that they be versatile with respect to shelf or support positioning, in order to accommodate different types of displays and product lines. A commonly employed display system would be expected to include a plurality of cantilevered supports for shelving panels or the like, a display wall that features a plurality of display wall support mountings arranged in a suitable array, and a plurality of support brackets that can be inserted in selected ones of the mountings and which have a cantilevered arm that support the shelves or products at the display wall. The functional geometry of the interacting support mounting wall, with respect to strength, ease of installation and removal, and cost, are strong marketplace differentiators between the available systems.

A display mounting system of the above-described type, well known in the art in Australia is supplied by Australian Slatwall Industries Pty Ltd and is sold under the trademark SLATWALL™. Problems inherent with this type of system, that will be familiar to those skilled in the art, include an inability to support heavy loads. These problems are described in more detail in Australian Patent Document No. 2004201505, the contents of which are incorporated herein by reference.

The above patent document further describes an improved shelving bracket mounting system and in particular describes an arcuate anchor portion for the cantilevered arms which has various benefits over the existing SLATWALL™ display mounting system, as well as a particular cavity profile for receiving the cantilevered arms which, in combination, provide a secure retention of the mount in the cavity having a very good strength and practical utility. The cavity profile described in the patent document provides a good level of support for the anchor portion which has a different profile to that of the cavity. A cavity which has an identical internal profile that is congruent or identical to the external profile of the anchor portion would provide improved support. That is, it would be most preferable to have a direct male-female correlation between the profiles of the anchor portion and cavity, i.e. a shape fit.

Unfortunately, the practical constraints of manufacture of shop fitting panels having grooves cut therein, whether they be constructed from extruded aluminium, craft wood or other material, mean that it would be expensive and somewhat difficult to reliably produce an exact groove of the type required in such panels.

It is an object of the present invention to provide panels for a display mounting system wherein an improved receiving cavity is provided for an arcuate anchor portion of a display support bracket which can be manufactured in a reliable and cost effective manner.

It is a further object of the invention to provide a system for mounting such panels to a shop wall which facilitates rapid installation of the panels and minimizes the appearance of screws, bolts or other fastening devices when installed.

OBJECT OF THE INVENTION

It is an object of the present invention to overcome or ameliorate at least one of the disadvantages of the prior art, or to provide a useful alternative.

It is an object of the invention in a preferred form to provide a display apparatus for mounting display brackets.

It is an object of the invention in a preferred form to provide an elongate insert element that is useable in a display apparatus for mounting display brackets.

These and other objects, features, and advantages of the present invention may be more clearly understood and appreciated from a review of ensuing detailed description of the preferred and alternate embodiments and by reference to the accompanying drawings and claims.

SUMMARY OF THE INVENTION

According to an aspect of the invention there is provided a display apparatus for mounting display brackets, the display brackets having a male anchor portion having a profile which is an upwardly curved tab of substantially even thickness, the apparatus comprising:

- an elongate insert element having an anterior face and posterior face;
- the elongate insert element having a pair of parallel longitudinal anterior lip portions that define an elongate longitudinal orientated slot aperture to a substantially horizontally orientated anchoring cavity for receiving the male anchor portion; the anchor cavity having a profile that substantially conforms to the profile of the male anchor portion.

Preferably, the anchor cavity is defined by an upper cavity surface and a lower cavity surface; upper cavity surface and a lower cavity surface having a common concentric curvature; the anchoring cavity being further adapted to receive the anchor portion having a profile which is a curved tab of substantially even thickness; and the anchoring cavity being of a co-operating substantially uniform width for receiving the curved tab.

Preferably, the anterior lip portions protrude to define an upper surface and lower surface that is substantially perpendicular to the anterior face. More preferably, the insert element profile vertically-broadens, from the anterior face toward the posterior face, with respect to the lip portions. Most preferably, the insert element has an exterior profile that is substantially symmetric about a central horizontally orientated plane.

Preferably, the insert element has a single posterior protruding longitudinal rib element. More preferably, the rib element is integrally formed with the insert element.

Preferably, the insert element has a substantially rectangular profiled body portion.

Preferably, the insert element comprises a length of extruded metal. More preferably, the insert element comprises a length of extruded aluminium. Most preferably, the insert element is a length of extruded aluminium.

Preferably, the apparatus further comprises a panel having an anterior surface and a posterior surface, having one or more insert element being located within the panel. More preferably, the lip portions of the insert element are in substantial vertical alignment with the anterior surface of the panel. Most preferably, the panel is thereby adapted to receive a male anchor portion via the anchoring cavity located in the anterior surface.

Preferably the panel includes one or more insertion cavity for slidably inserting each of the respective one or more insertion element. More preferably, the insert element has an exterior profile that is substantially symmetric about a central horizontally orientated plane; and each insertion cavity is created by a router tool.

Preferably, the anterior lip portions protrude to define an upper surface and lower surface that is substantially perpendicular to the anterior face such that an insertion cavity preserves sufficient panel material about the anterior surface to retain the insert element within the insertion cavity, while resisting breakage of the preserves panel material.

According to an aspect of the invention, there is provided a display wall for a product display system, shelving brackets or similar items, the shelving brackets or similar items having a male anchor portion adapted to be received by an anchoring cavity, the wall being comprised of:

a. a plurality of interconnectable panels, each of the panels having anterior and posterior surfaces and having upper and lower edge surfaces; each panel having upper and lower coupling projections, each extending from a posterior position at or near an upper and a lower traverse edge of the panel, respectively;

b. wherein the projections provide a complementary tongue and groove arrangement for assembly of a plurality of the panels into an upright wall;

c. characterised in that the upper projection has a first surface that extends from the upper traverse edge in a posterior direction and an upward manner away from an anterior surface of the panel, the lower projection has a second surface that extends from the lower traverse edge in a posterior direction and an upward manner away from the anterior surface of the panel, the first and second surfaces defining an anchoring cavity in an assembled state of two interconnected panels, in which can be received the male anchor portion of the brackets.

It will be understood by those skilled in the art that, while brackets for the support of shelves may be a major use for this invention, it may equally be applied to a variety of other related items such as hooks, coat rails or other specialized support or display items.

An advantage of the system described above is essentially that the cavity for receiving the anchor portion of the cantilevered support is formed at the junction of the two panels. This means it is not necessary to cut or extrude what may be an otherwise difficult profile into the front of the panel itself. Instead, the desired profile is partly formed at the lower edge of the upper panel, partly at the upper edge of the lower panel, and the cavity itself is formed by the bringing together of these upper and lower edges in adjacent, spaced-apart arrangement, when installed.

In addition, the ability to form the panel structure described above in a relatively rapid manner will allow the whole structure to be formed in a relatively rapid manner, saving labor costs attendant on installing such a shelving system.

A further advantage of such a system is that potentially only the relatively narrow opening of the cavity will be visible in the installed and assembled panel, promoting a better aesthetic in relation to the overall appearance of the panel.

This design facilitates the cost-effective mass production of standard panels, in particular via aluminium extrusion.

Preferably, the anchoring cavity is adapted to receive an anchor portion having a profile which is an upwardly curved tab of substantially even thickness; in particular having a curved profile of a substantially constant radius of curvature, and advantageously wherein the curve extends though a substantially circular segment of approximately 90°, in order to fully exploit the advantages of the anchor portion identified in Australian Patent Document No 2004201505, discussed above.

In one embodiment, the profile of the cavity is upwardly curved away from the anterior surface and is of substantially even height, in order to match the profile of the preferred anchor portion of the above described anchor portion. Another embodiment of the anchor portion and corresponding cavity is achieved where the curved profile is of a substantially constant radius of curvature. This allows considerable ease of installation and removal of the anchor portion. In a disclosed embodiment the curve extends through a substantially circular segment of approximately 90°.

An embodiment of the posterior projections of the upper and lower panels occurs wherein the coupling projection extending from the upper surface of the panel includes, in profile, a male tang, and wherein the coupling projection extending from the lower surface of the panel includes, in profile, a female cavity adapted to make resilient engagement with the tang.

This arrangement has been found to be relatively simple to install, while providing the requisite strength for the support of the composite structure of which the panels form part.

In an embodiment of the mounting system described above, the coupling projection extending from the upper surface of the panel includes, in profile, one inner and one outer upwardly curved male tangs sharing substantially the same center of curvature, and wherein the coupling projection extending from the lower surface of the panel includes, in profile, a female cavity adapted to receive the inner tang; and wherein the outer tang is adapted to make engagement with an outer surface of an identical the coupling projection extending from the lower surface.

This embodiment provides great ease of installation and dismantling, as the structure allows a simple pivoting movement to engage the upper and lower panels and to maneuver them into position.

The outer surface of the coupling projection extending from the lower surface features a convex curvature which substantially shares center of curvature with the outer tang.

In a disclosed embodiment, the end of the outer tang features a detent notch adapted to make resilient engagement with a complementary detent depression in an upper portion of the coupling projection extending from the lower panel. The complementary notch and depression enhances the ability of the panels to make resilient engagement with one another.

According to another aspect of the invention, there is provided a modular display system, including a plurality of panels, according to those defined above, and a plurality of removable cantilevered support brackets mountable to the wall at selectable anchoring locations, wherein the support brackets have a terminal male anchor portion adapted to be received in the anchoring cavity formed by the interlocking connection of the panels, according to those defined above.

As will be discussed below, in one embodiment the posterior surface of the panels features two or more secondary posterior projections which are adapted to receive a positioning lug in the channel formed therebetween. Such an embodiment will allow the construction of a system for securing the above described mounting system to a wall, the system including:

a. two or more vertical support members arranged in a secure manner adjacent the wall, the members featuring channels adapted to receive a lug anchor, the channels being open toward the anterior side of the support member;
b. one or more lug anchors being received within the channels, the anchors having a width dimension greater than the width of a main portion of the channel opening, such that the anchors may move freely within the channel but may not pass through the channel opening; and
c. positioning lugs connected to the lug anchors and extending therefrom through the channel opening;
d. wherein the lugs are inserted between the secondary posterior projections of the panels in order to make resilient connection with the panels.

One advantage of this system is that the panels may be installed easily manually by simply positioning the channel formed by the secondary projections in front of the lug, and pushing the channel onto the lug.

Another advantage is that the vertical positioning of the anchor-receiving channel is thereby made flexible, due to the fact that the lug anchor may be moved freely within the channel in the vertical support member, and thereby is enabled to engage with the panel at any height. The height at which the anchor receiving channel occurs is determined by the height and number of the panels which vertically support it from below.

In a disclosed embodiment, the lugs feature barb-like projections on their outer surface, the projections being arranged to engage with similar projections on the facing surfaces of the secondary posterior projections to effect the resilient connection, thereby forming a more secure installation of the panels. In a disclosed embodiment, the lugs are made from steel.

An embodiment of the vertical support members is provided wherein the channel opening is, at predetermined positions, wider than the width of the lug anchors to allow the lug anchors to be inserted into the channel. This facilitates rapid installation of the overall system, in that the lug anchors may be inserted or removed.

According to another aspect of the invention, there is provided a mounting system for shelving brackets or similar items, the shelving brackets or similar items having a male anchor portion adapted to be received by an anchoring cavity, the system including at least one panel having an anterior face and a posterior face, the panel adapted to receive an anchor portion having a profile which is an upwardly curved tab of substantially even thickness via a cavity located in the anterior face, wherein the cavity is a horizontally oriented slot which has a profile substantially matching the profile of the anchor portion, featuring an upwardly curved portion of substantially even height, and wherein the slot is present in an insert which is received by the panel, the insert preferably being a length of extruded metal, such as aluminium.

An advantage of such a system, as compared with the prior art, is that the matching of the profile of the cavity to the anchor portion is that the anchor portion may be supported along it's entire length, rather than at specific points, which increases the stability of the anchor portion. Another advantage is that the use of an insert to provide the required cavity allows the above advantageous cavity to be installed reliably in a variety of materials.

Now will be described, by way of a specific, non-limiting example, a preferred embodiment of the invention.

BRIEF DESCRIPTION OF THE DRAWINGS

A preferred embodiment of the invention will now be described, by way of example only, with reference to the accompanying drawings in which.

DETAILED DESCRIPTION OF THE DISCLOSED EMBODIMENTS

While the present invention will be described more fully hereinafter with reference to the accompanying drawings, in which various embodiments of the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
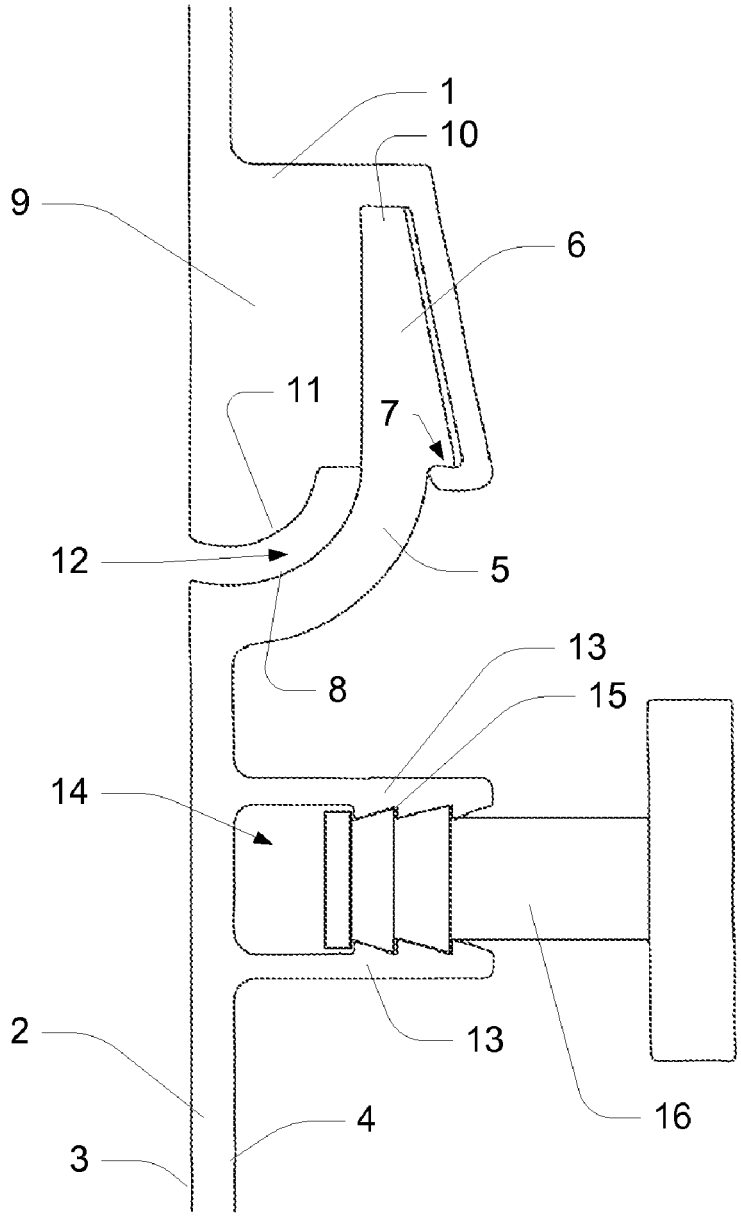
FIG. 1 depicts a profile view of a junction of two panel sections according to the invention.

Turning first to FIG. 1, there is shown a schematic profile of a junction of an upper panel 1 and a lower panel 2 according to an embodiment of the invention. The panels are shown to have anterior, or front, surfaces 3 and posterior or rear surfaces 4. The lower panel 2 features an upwardly curved portion 5 which is adapted to engage with the upper panel 1. This curved portion 5 features a male protrusion 6, further featuring an engaging notch 7. The upper surface 8 of this curved portion 5 features a curvature which is designed to directly engage with the underside surface of an anchor portion of a shelving bracket (not shown).

The lower end of the upper panel 1 also features a rearwardly protruding member 9 which defines a female cavity 10 for receiving the upwardly curving portion 5 described above. The lower edge of the upper panel 1 also defines an upwardly curved surface 11, which is adapted to engage with an upper surface of an anchor portion of a shelving bracket (not shown).

According to the invention, the upper edge (not shown) of the upper panel 1 features a profile identical to the upper edge of the lower panel 2. Equally, the lower edge (not shown) of the lower panel 2 features a profile identical to the lower edge of the upper panel 1.

It will further be apparent in FIG. 1 the manner in which the male engaging portion 6 of the lower panel 2 interlocks with the female cavity 10 featured at the lower portion of the upper panel 1. It will further be noted that the curved cavity 12 which is formed between the upper and lower panels is formed by the engagement of these two panels and is adapted to receive a curved anchor portion of a shelving support bracket (not shown).

Both of the panels (although not shown in the upper panel 1) also feature two rearwardly protruding projections 13, which extend substantially across the width of the panels. A cavity (in the form of a channel) 14 is formed between the projections. The inner walls 15 of the channel 14 feature a barbed profile. This profile is adapted to receive an anchoring lug 16 for installation of the panels in a panelling system.

Figure 2:
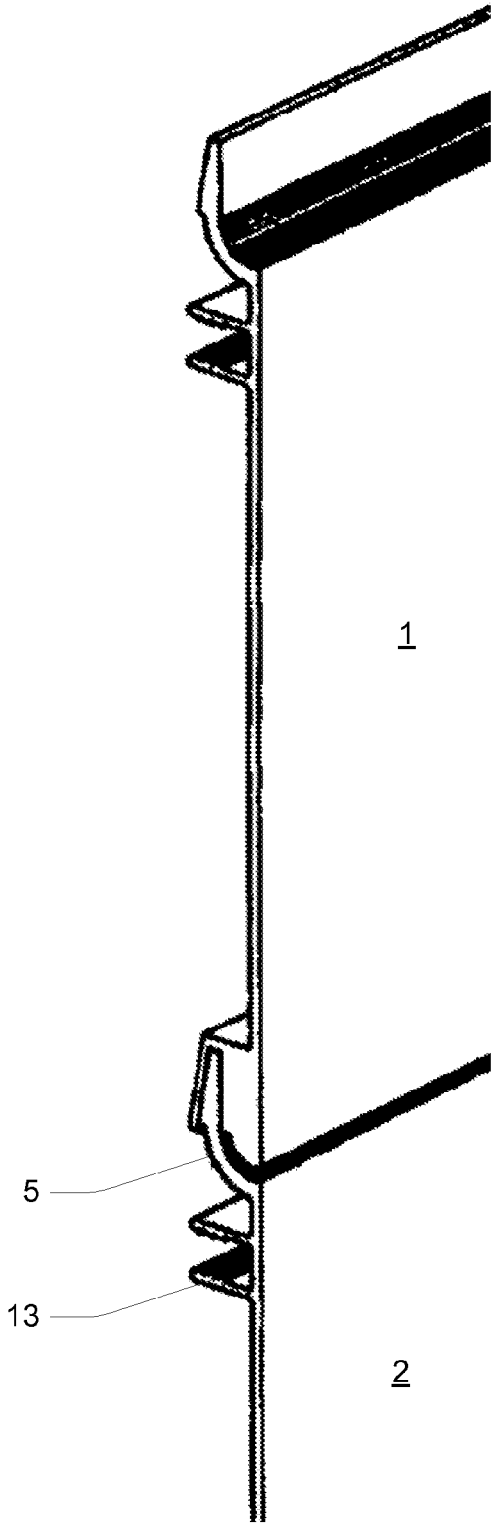
FIG. 2 depicts two panels according to the invention interlocked in a manner also according to the invention.

Turning now to FIG. 2, there is shown the upper panel 1 and lower panel in interlocking engagement.

Figure 3:
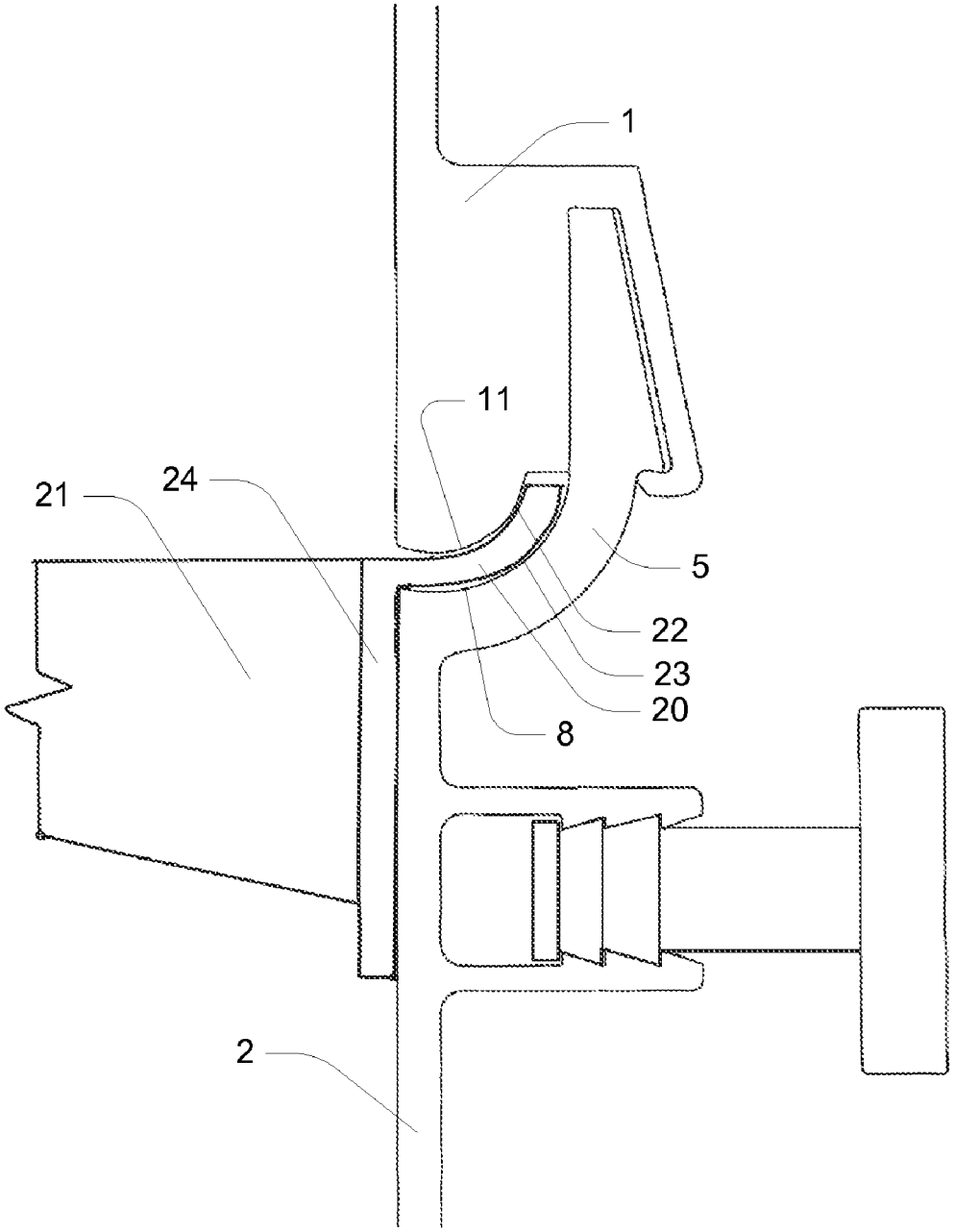
FIG. 3 depicts the junction between two of the panels according to the invention, forming a cavity therebetween and into which an anchor portion of a shelving support bracket has been inserted.

Turning now to FIG. 3, there is shown a junction between an upper panel 1 and a lower panel 2 of the type described above, thereby forming the cavity 12, and into which the anchor portion 20 of a shelving support bracket 21 (not shown in entirety) has been inserted. It will be appreciated that the shelving support bracket 21 is thereby effectively held in place on the "wall" formed by the interlocking panels by the interaction between the anchor portion 20 and the upper and lower panels, wherein the anchor portion 20 fits snugly inside the cavity 12 due to the curvature of the upper surface 8 of the curved portion 5 of the lower panel 2 and the curvature of the lower edge 11 of the upper panel 1 (which have been chosen to match the curvature of the anchor portion 20), and can only be removed by an upward pivoting of the bracket 21.

Thus the upper curved surface 22 of the anchor portion 20 interacts with the upper internal curved surface 11 of the cavity 12 in particular to prevent the anchor portion 20 being withdrawn in a horizontal direction from the cavity 20. The lower curved surface 23 of the anchor portion 20 rests on the lower curved surface of the cavity 8 to prevent downward movement of the shelving support bracket 21 and the back plate 24 of the shelving support bracket 20 presses on the front surface 3 of the lower panel 2 to prevent a downwards rotation in a clockwise direction (as shown) of the support bracket 21 relative to the anchor portion 20 as illustrated.

Figure 4:
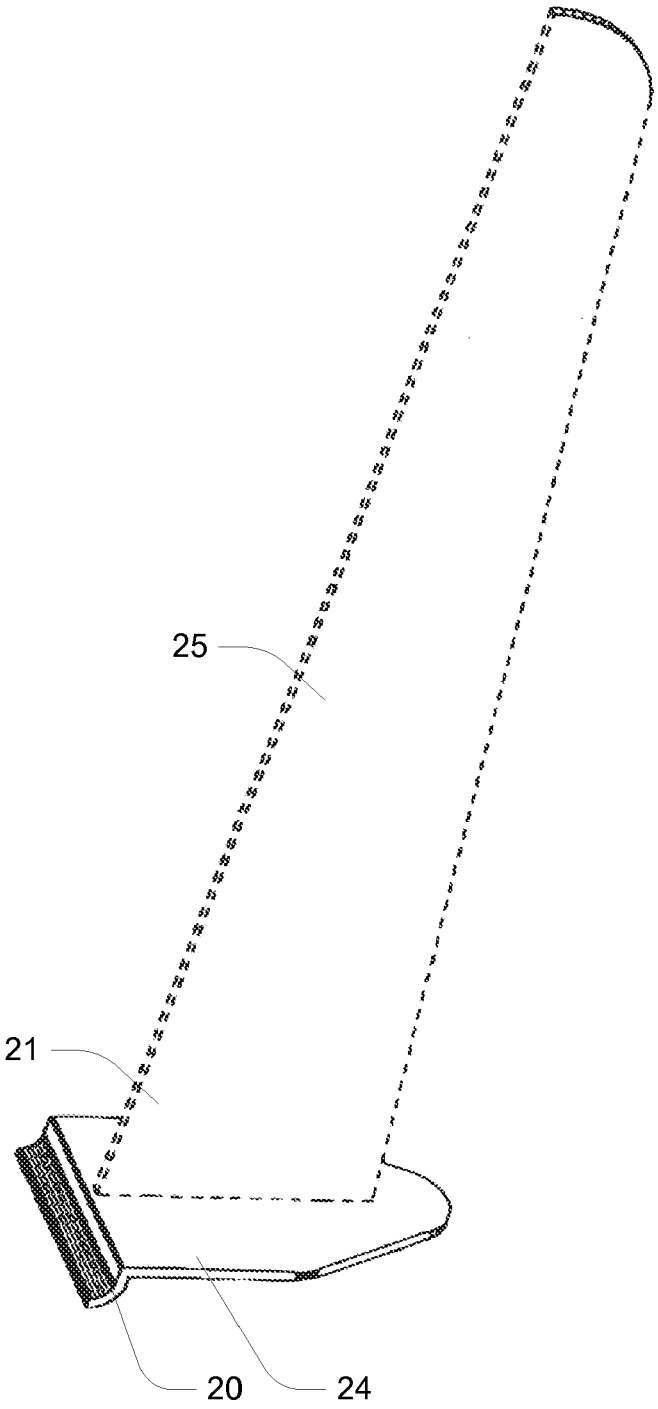
FIG. 4 depicts a shelving support bracket according to the invention.
Figure 5:
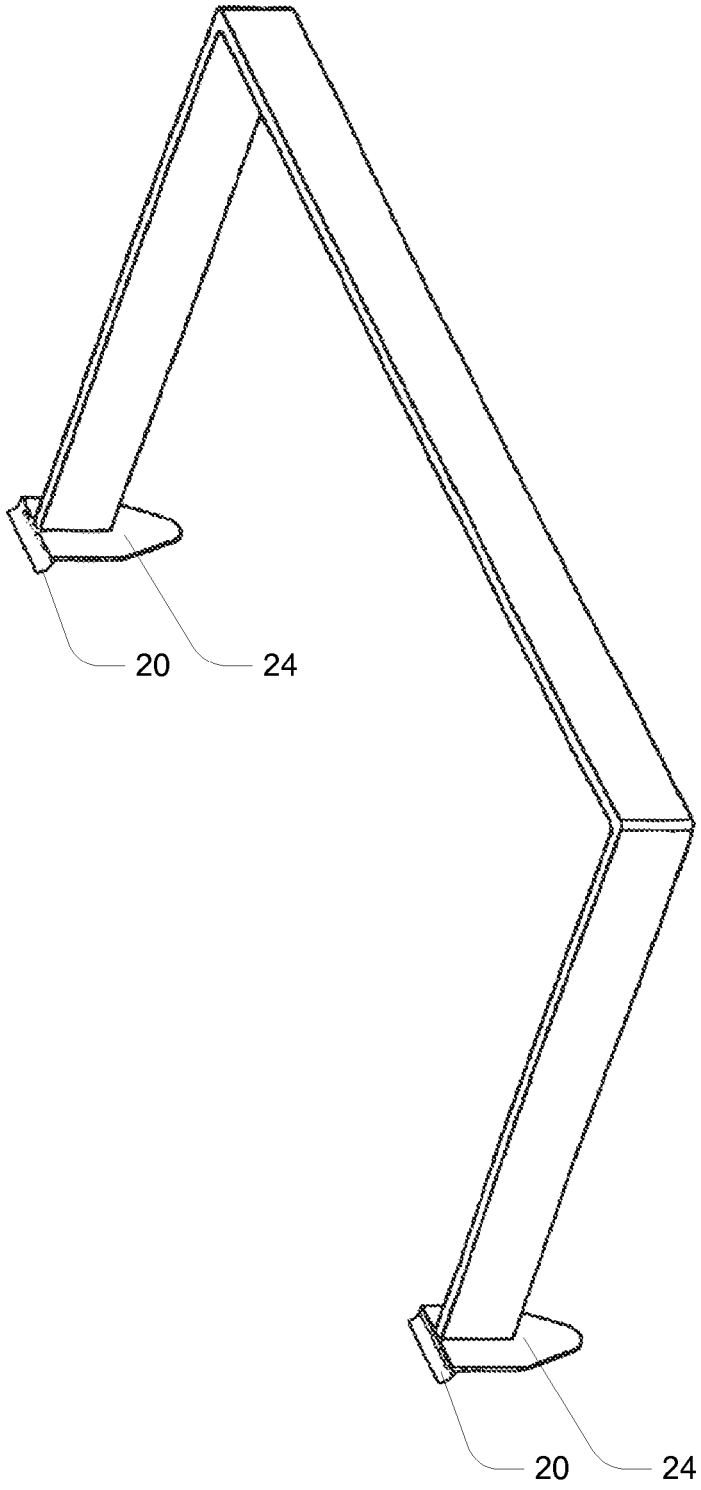
FIG. 5 depicts a coat rack according to the invention.
Figure 6:
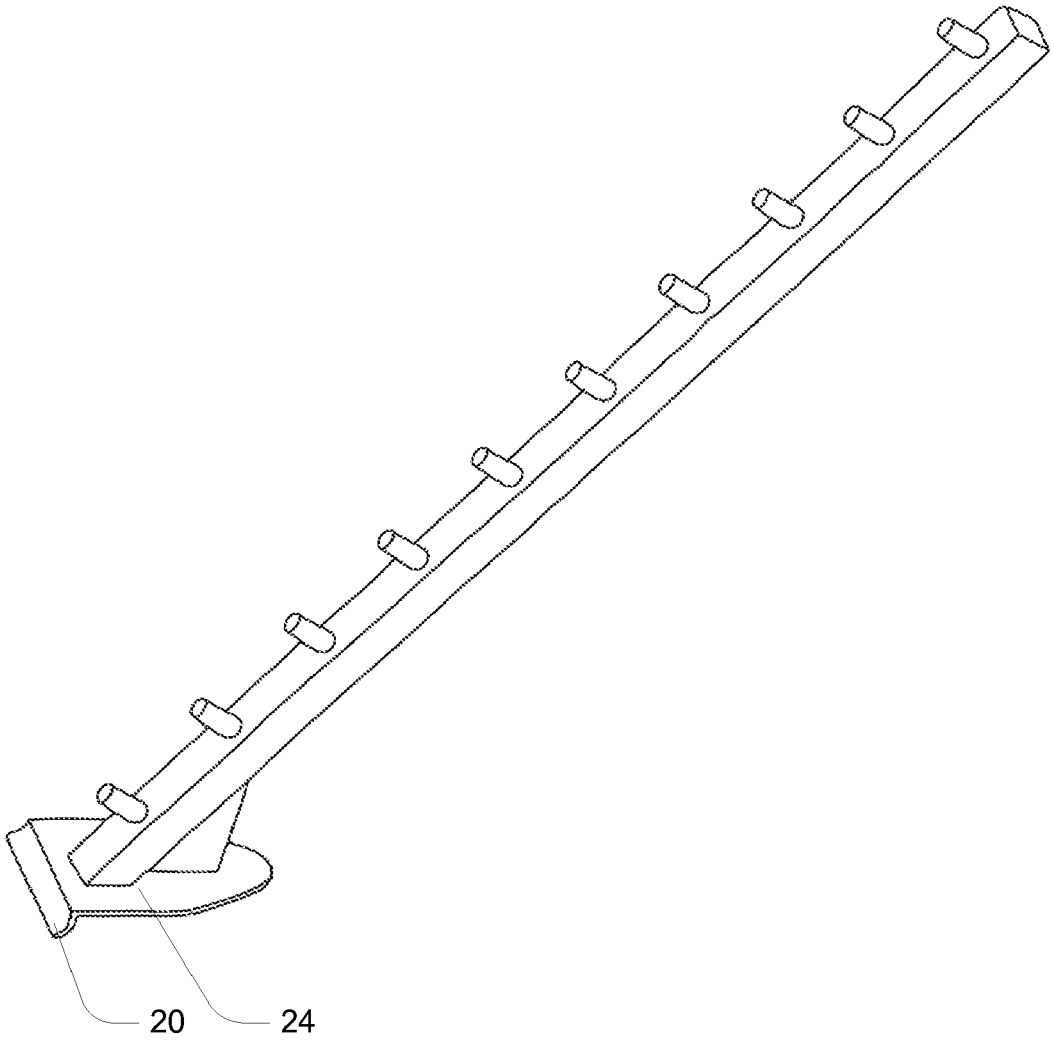
FIG. 6 represents an alternative coat rack according to the invention.
Figure 7:
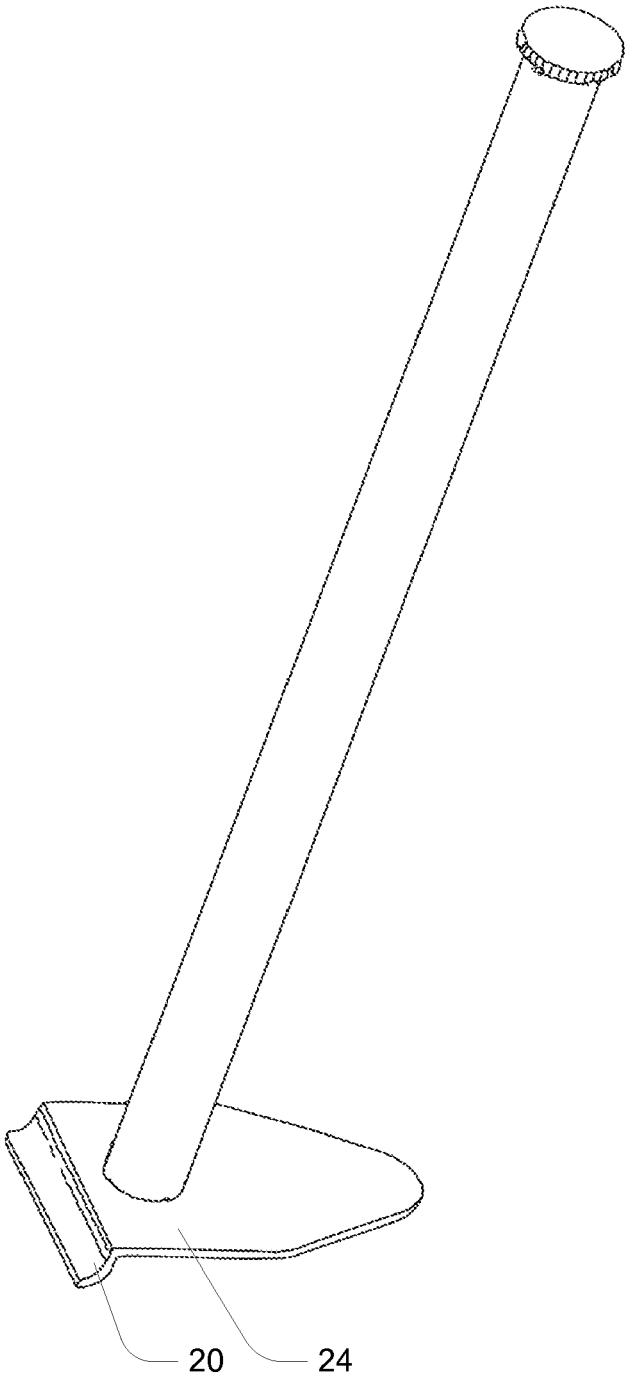
FIG. 7 depicts an alternative coat rack according to the invention.
Figure 8:
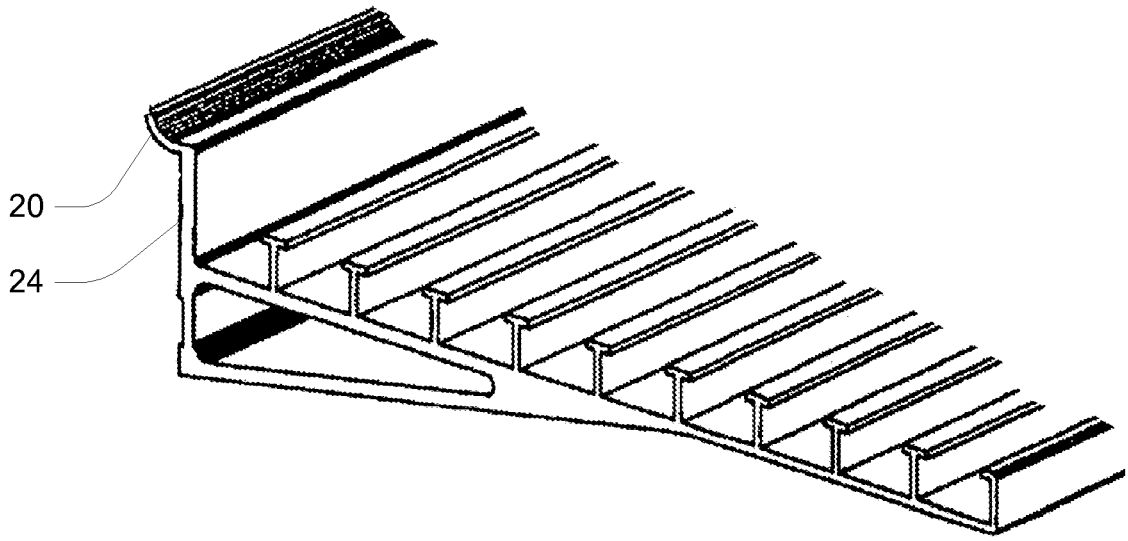
FIG. 8 depicts a compact disc display shelf according to the invention.
Figure 9:
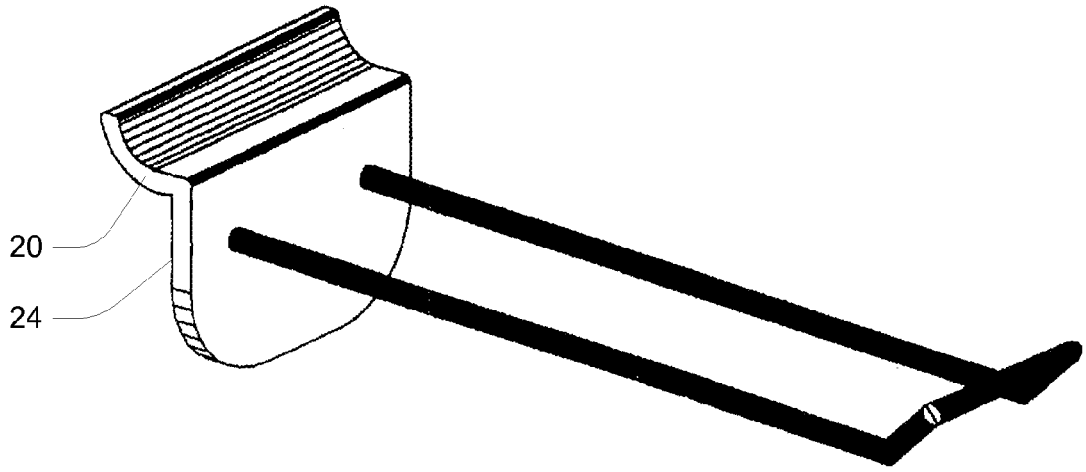
FIG. 9 depicts a display hook according to the invention.

FIG. 4 shows an archetypal shelving support bracket 21 of the kind which may be used in conjunction with the present invention. The curved anchor portion 20 is illustrated attached to a horizontal plate 24. To the horizontal plate 24 is appended a cantilever member 25 adapted to support a shelf. It will be noted, via the rendering of the shelf support cantilever member 25 in dotted lines, that many other structures, designed for many other purposes, may equally be appended to the vertical plate of the cantilever member. FIG. 5 through FIG. 9 illustrate a number of examples of support brackets for various purposes, including hanging racks of different types and, particularly in FIG. 8, a rack designed for holding compact disc cases.

Figure 10:
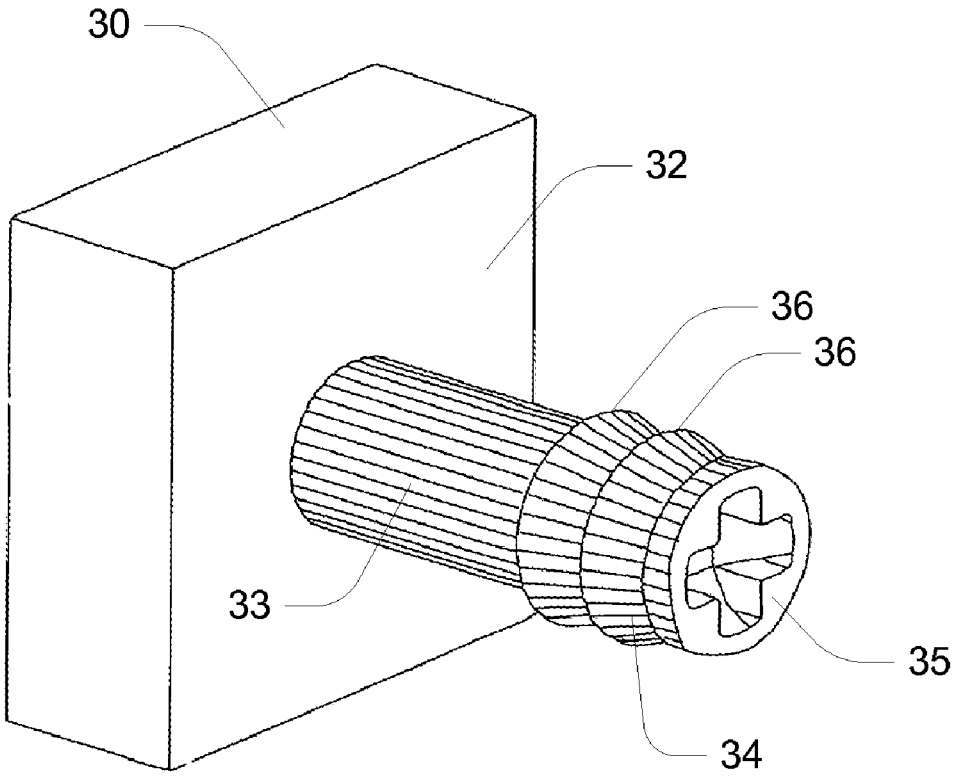
FIG. 10 depicts a positioning lug and lug anchor according to the invention.

Turning to FIG. 10, there is illustrated a lug anchor 30 and positioning lug 31 which are adapted to be used in accordance with the system for securing the mounting system to a wall, according with an embodiment of the present invention. The lug anchor consists of an aluminium block 32 into which the positioning lug 31 may be screwed or otherwise firmly affixed. The positioning lug 31 consists of a barrel portion 33, a barb portion 34 and a screwdriver-engaging portion 35. As illustrated, the barrel portion 33 connects that barb portion 34 to the lug anchor 30. The barb portion 34 consists of two conical protrusions 36 which are adapted to allow the easy insertion of the lug into the channel 14 formed by the posterior projections 13 on the panel 2 as described above. The positioning lugs are shaped to interact with the internal barbs 15 on the channel 14 as illustrated in FIG. 1. This physical arrangement allows the panels to be securely fixed in position via interaction with the lugs.

The screwdriver-engaging portion 35, in this particular embodiment illustrated as a Phillips-head screwdriver engaging portion, allows the lug 31 to be screwed directly into the block 32.

Figure 11:
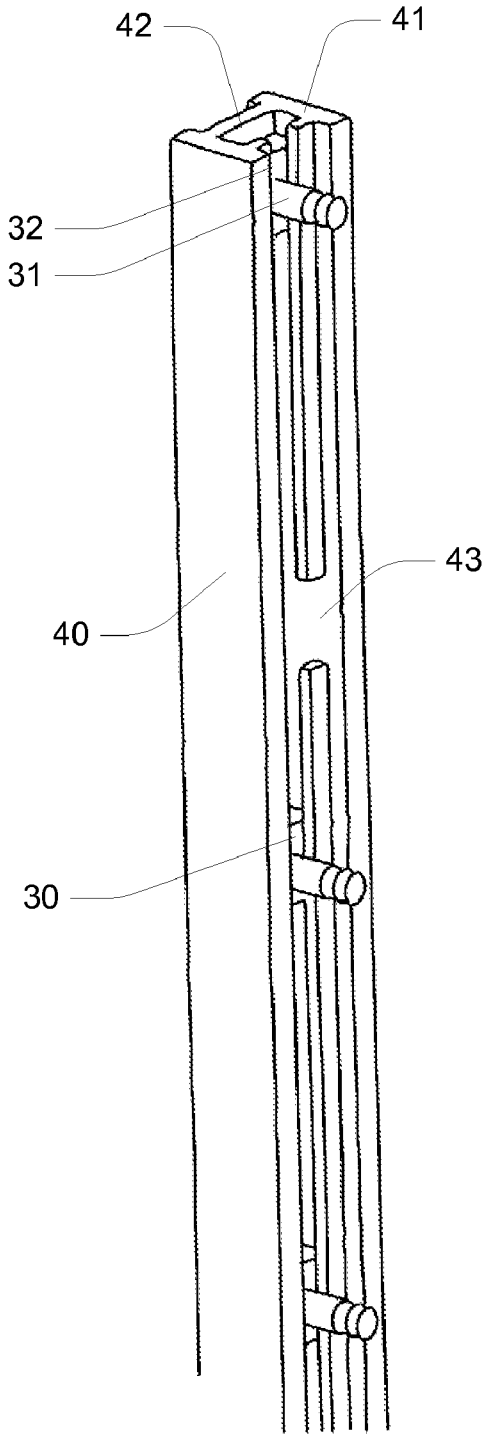
FIG. 11 depicts various lug anchors inserted in a vertical member according to the invention.

Turning now to FIG. 11, there is a shown a vertical support member 40 for a shelving support system according to an embodiment of the invention. The support member as illustrated consists of an extruded aluminium beam 41, the beam featuring an overall "C-shape" profile. This profile provides an internal channel 42 of dimensions similar to the size of the block 32 which forms part of the lug anchor 30 as described above. This channel 42 is adapted thereby to receive the block 32 of the lug anchor 30 as illustrated. The gap in the channel has a width adapted to allow the barrel portion 31 of the positioning lug to protrude therethrough, in order to engage with the panels which comprise part of the system.

During installation, the installer can slide the block 32 down the channel 42 until it has reached the desired position to attach to the panels. It will be noted that in this embodiment the block 32 is sized so as to allow free movement of the lug anchor in the receiving channel 42. This allows considerable flexibility when installing panels of differing heights.

In an embodiment illustrated in FIG. 11, at least one further opening 43 is provided to the channel 42 which is sized to allow the insertion of the entire lug anchor at an intermediate point along the channel 42, rather than exclusively at the end of the channel 42. This provides the installer with additional flexibility, especially when working with longer versions of the support member 40, in regards to the position in which the lug anchors 30 are inserted.

Figure 12:
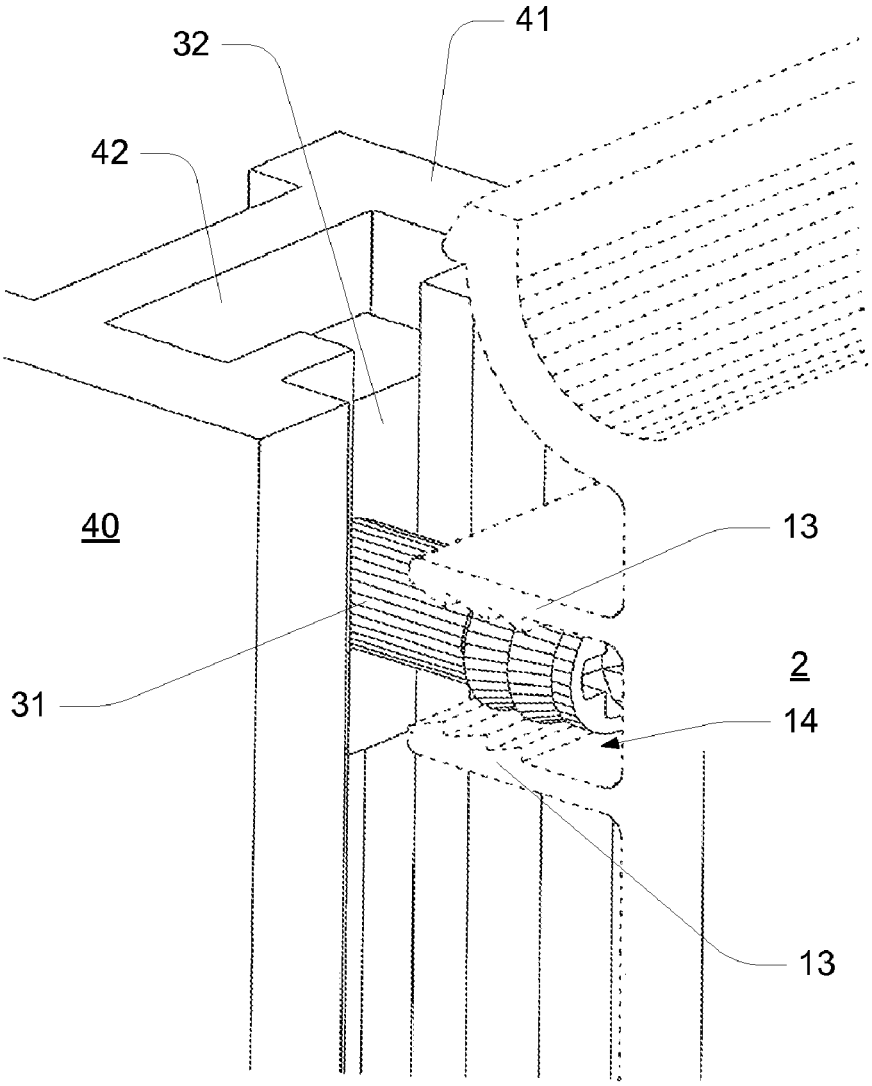
FIG. 12 depicts a panel according to the invention connected to a positioning lug which is located in a vertical support member according to the invention.

Turning now to FIG. 12, there is shown a block 32 inserted in the channel 42 formed by the vertical support member 40, and wherein a barrel portion 31 is shown protruding through the gap in the channel 42. In addition, shown in dotted lines, is the prospective position of a panel according to the invention. The barrel portion 31 has been inserted in between the rearward protrusions 13 to the panel 2, and has been received in a resilient manner inside the channel 14 formed between the protrusions. In this manner, the panels are attached to the support member during installation.

Figure 13:
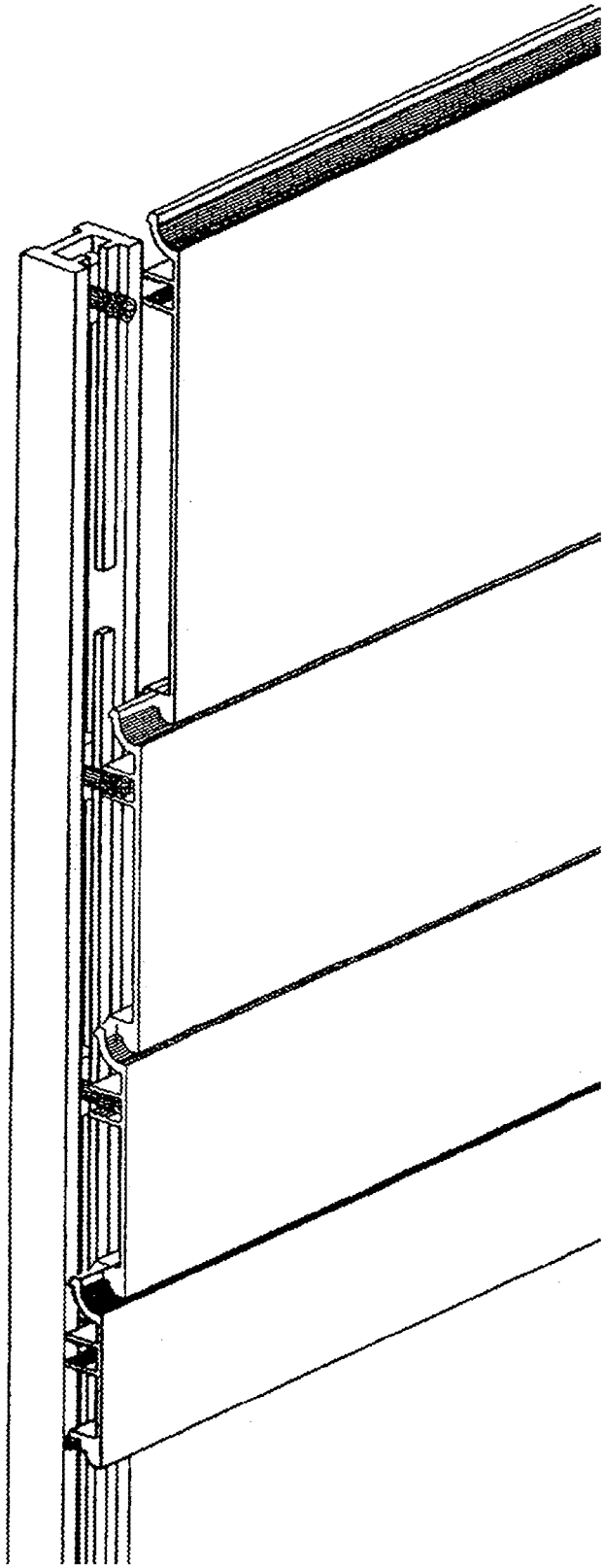
FIG. 13 depicts four interlocking panels according to the invention positioned adjacent a vertical support member and connected to same via position lugs.

Turning now to FIG. 13, there is shown a number of panels installed in an interlocking manner and connected to a vertical support member 40 in the manner described above. In this particular illustration, it will be noted that the panels are in fact slightly offset from their proper installed position, in order to illustrate the relative positioning of the panels and the positioning lugs.

It will also be noted that the 'wall' provided by the formation of the panels may be constructed of any number of separate interlocking panels. The panels may also be of varying heights, depending on the desired positioning of the shelf support inserts of the shelving system.

In an embodiment of the invention all of components discussed above are constructed from extruded aluminium. This material is light and strong and the shapes of most of the components discussed above, in particular the panels and the vertical support member have been designed to facilitate their manufacture by this method. In particular, where the components are manufactured as aluminium extrusions, they may be produced relatively cheaply and can be delivered at precise dimensional tolerances. In addition, aluminium provides an ideal substrate for a variety of coatings and finishes. It will be understood, however, that other materials are also suitable for the present invention.

Turning to FIG. 14 through FIG. 17, there is shown another embodiment of the invention featuring an alternative geometry of the upper and lower edge surfaces. In particular, it will be noted that the upper edge 70 of the relatively lower panel 71 features two upwardly curved portions (72, 73) which are adapted to engage with the lower edge surface 74 of the relatively upper panel 75. An inner portion 73 and an outer portion 72 which define between them a channel 76 adapted to receive a complementary downwardly curved portion 77 of the lower surface 74 of the relatively upper panel 75 when the panels are in engagement.

It will also be noted that the outer upwardly curved portion 72 features an engaging notch 78 which is adapted to engage the shoulder 79 of the rearwardly projecting part 80 of the lower edge 74 of the relatively upper panel 75 to effect locking into relative positions of the panels.

It will further be noted that center of curvature of the upwardly curved portions (72, 73), as well as the downwardly curved portion, coincide with the center of curvature of one another and with the upper and lower surfaces (81, 82) adapted to engage with the anchor portion of the shelving support bracket.

Figure 14:
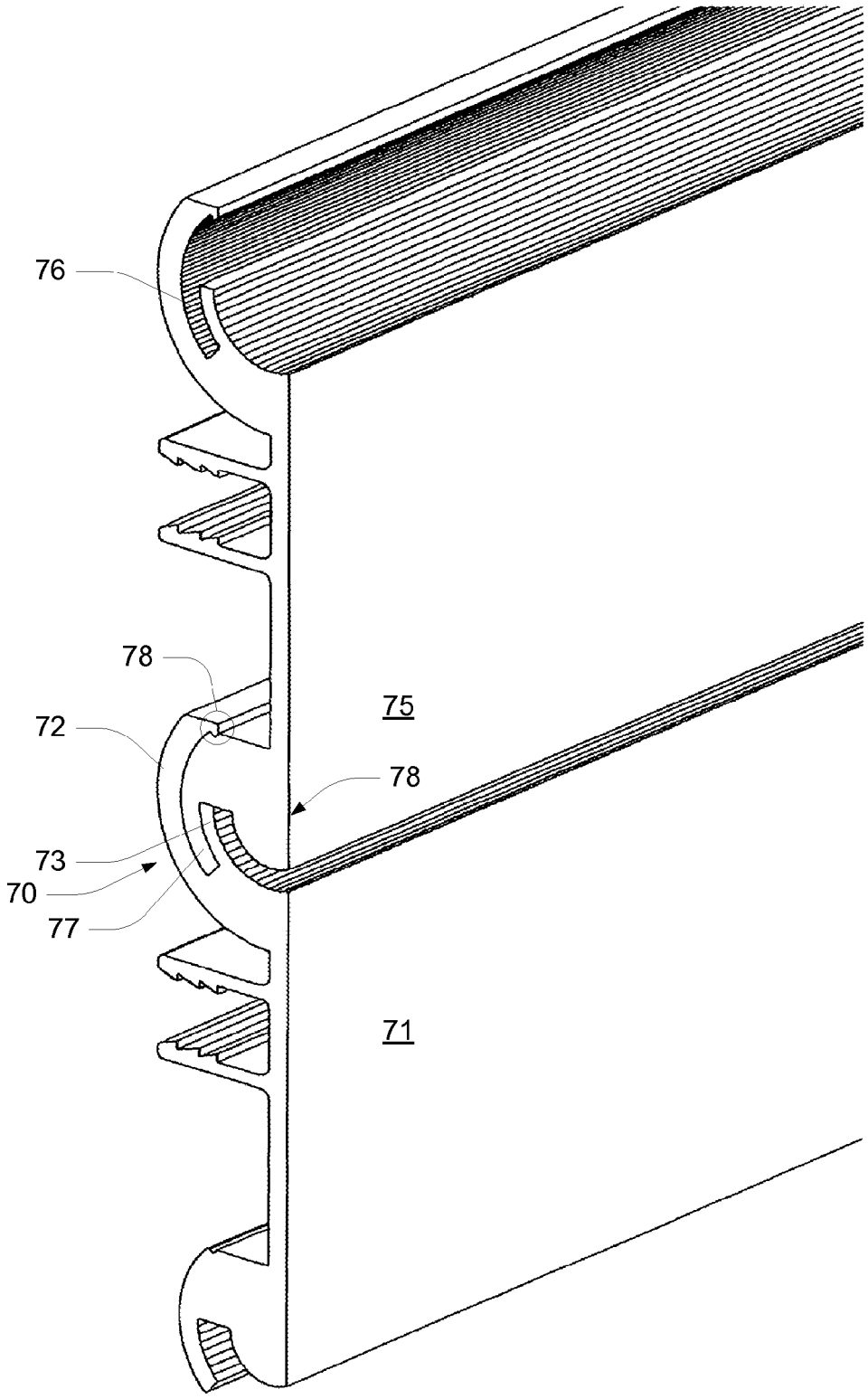
FIG. 14 depicts an orthogonal view of an alternative embodiment of the panels of a shelving system according to the invention.
Figure 15:
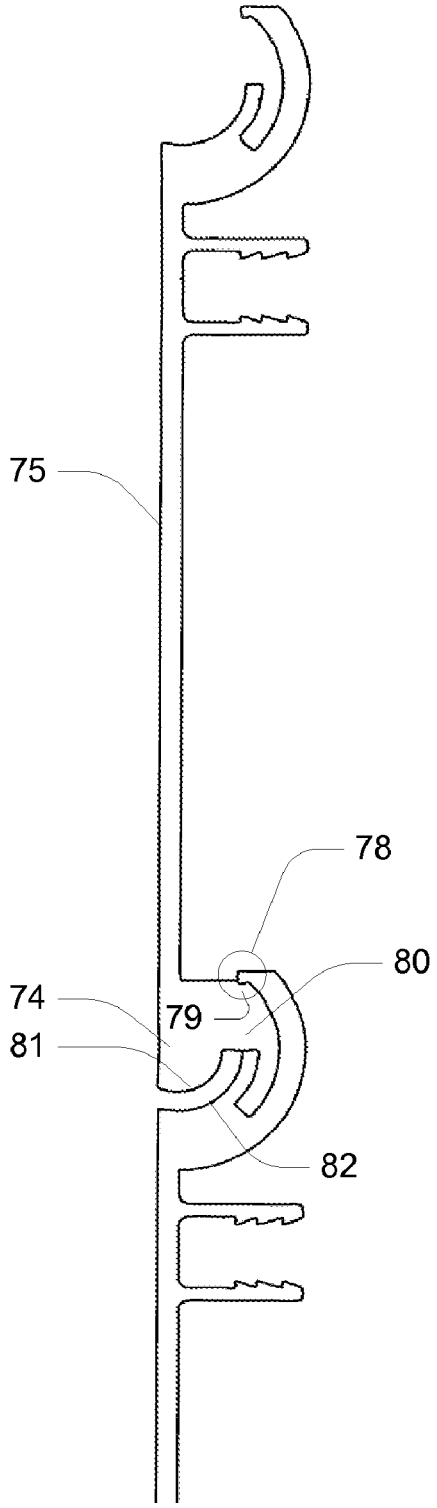
FIG. 15 depicts a side view of the system of FIG. 14.

As further shown in FIG. 14 and FIG. 15, each interconnectable panel in a display wall includes an extruded aluminium section comprising a central web having an integral terminal enlargement along each of the upper and lower longitudinal edges. The upper enlargement, defining the upper edge 70, is both curved and bifurcated to define a similarly curved and concentric inner finger 73 and outer finger 72, between which fingers are located a curved channel 76. The outer finger is longer than the inner finger. The uppermost extent of the outer finger further comprises a downward facing engaging notch 78. Accordingly, a gap is formed between the notch and the uppermost extent of the inner finger 73. This gap forms a throat or entry into the downward extending closed ended channel 76 that is located between the fingers 72, 73. The gap or throat between the free ends of the fingers 72, 73 is adapted to receive a portion of the lower enlargement 80, which enlargement 80 extends rearwardly. The lower enlargement 80 is bifurcated by a longitudinal groove to form the downwardly curved intermediate finger 77 that conforms in shape and length to cooperate with and enter the longitudinal channel 76.

The panels are engaged by interdigitating them in rotation. When engaged, the top surface 82 of the inner finger 73 and the bottom surface 81 of the lower enlargement 80 form a curved longitudinal anchor slot that is curved in the same way as the fingers 72, 73. The anchor slot preferably has a constant radius so as to engage brackets with a radiused anchor portion 20 as shown in FIG. 4. The upper surface of the anchor slot is formed by the radiused lowered surface of the lower enlargement of the upper panel.

The anchor slot thus formed is an arc having a common concentric curvature as the inner and outer fingers 72, 73, the channel 76 and the finger 77. Note that the free length of the inner finger 73 is about the same length as the length of the intermediate finger 77. An upper surface of the lower enlargement further comprises a longitudinal shoulder 79 for receiving the engagement notch 78. Thus, the uppermost extent of a lower panel extends above but engages with the shoulder on the uppermost surface of a lower enlargement 80 of a panel that is adjacent to and above it. As best shown in FIG. 15, the intermediate finger 77, within the context of a sliding interdigitating fit required for assembly, occupies practically the entirety of the channel 76 formed between the bifurcations 72, 73. Further, the lower extremity of the intermediate finger 77 reaches, for practical purposes, the terminal or closed end of the channel 76. Because the inner and outer fingers 72, 73, the channel 76, and the intermediate finger 77 have a cooperating concentric curved configuration when assembled, the adjacent panels engage and disengage with one another by rotation relative to one another.

Figure 16:
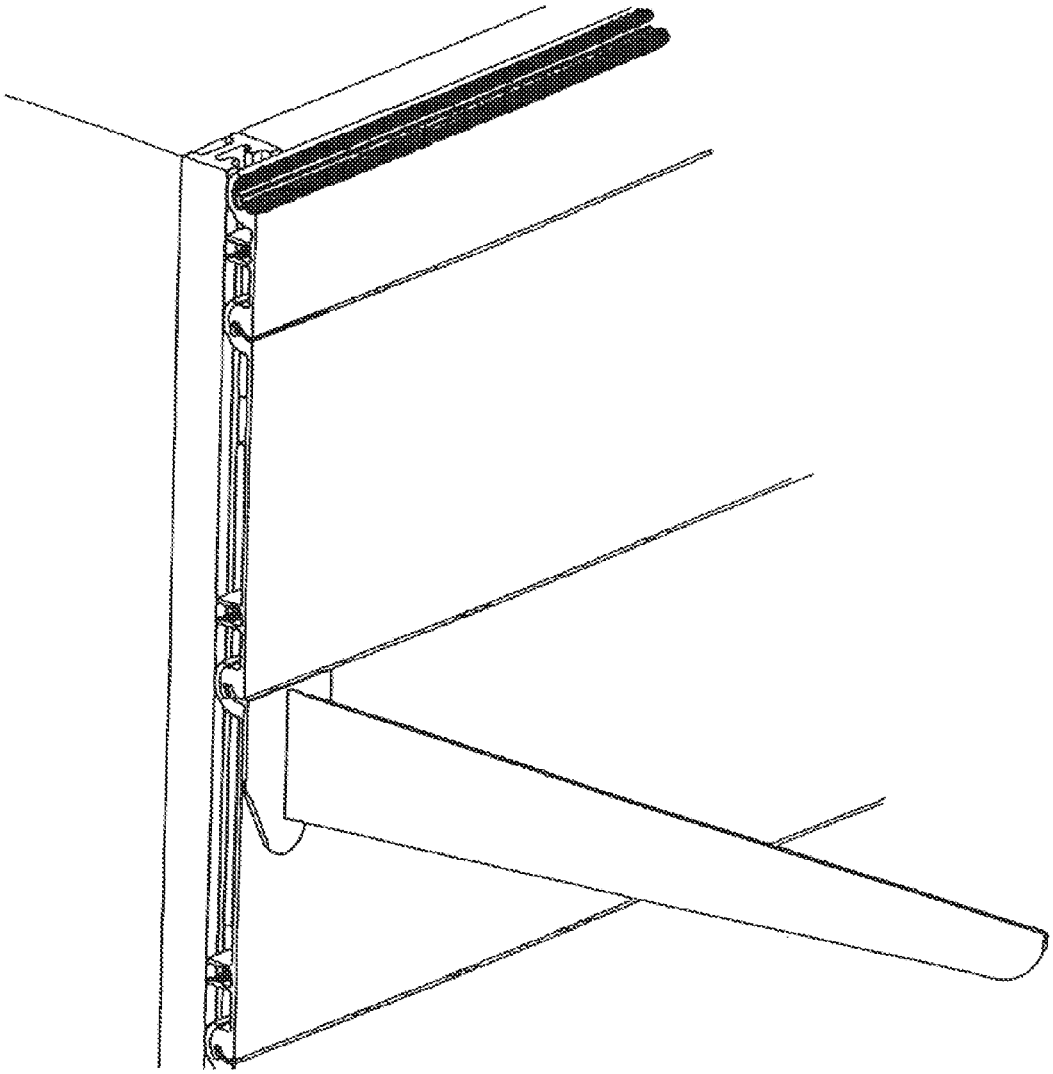
FIG. 16 depicts the junction between two of the panels of FIG. 14, forming a cavity therebetween and into which an anchor portion of a shelving support bracket has been inserted.
Figure 17:
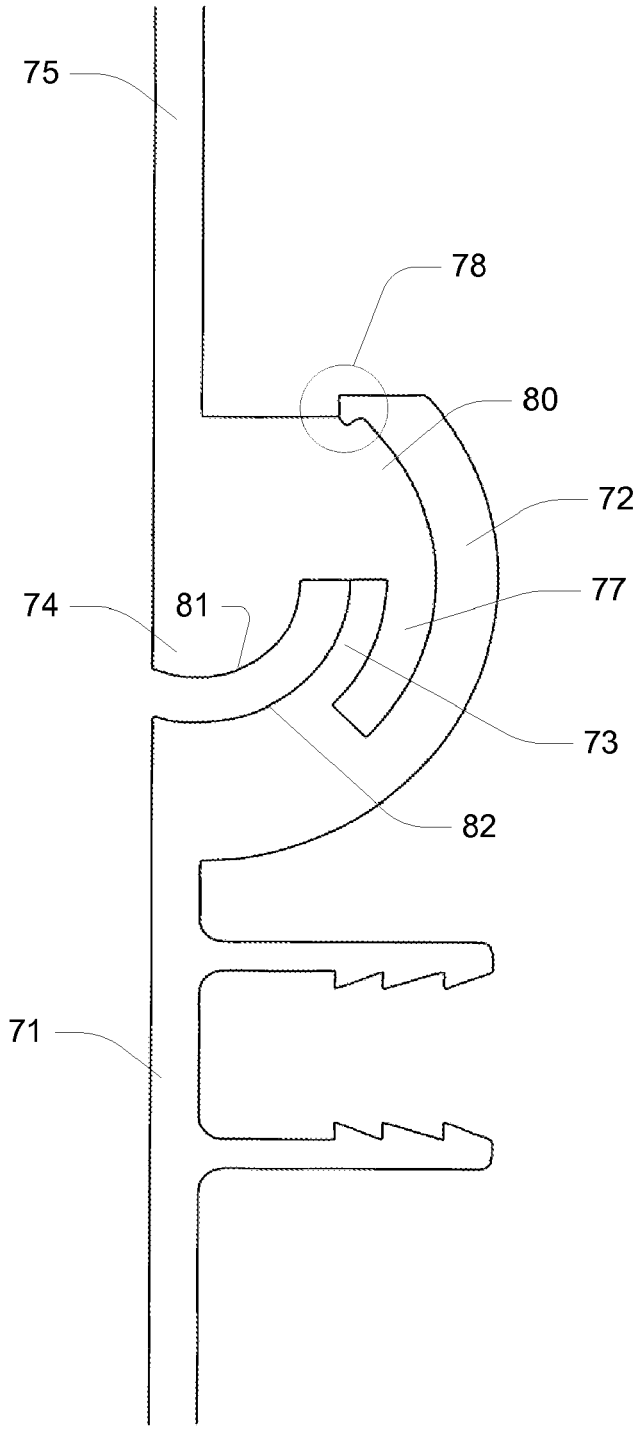
FIG. 17 depicts a particularly advantageous embodiment of the panels of FIG. 14.

FIG. 17 shows a version of the alternative embodiment depicted in FIG. 14, FIG. 15 and FIG. 16, with respect to particular dimensions.

The embodiment depicted in FIG. 14, FIG. 15 and FIG. 16 has advantages, in that it is easier to install, by virtue of being able to insert the lower edge of an upper panel into the upper edge of an already installed lower panel by presenting the upper panel in a relatively perpendicular orientation, and causing the above described engagement structures to engage in the manner described by tilting the upper panel into an upright position parallel to the lower panel.

This embodiment equally allows an easier method of disassembly of the panelling structure by the reverse of the above described procedure.

Figure 18A:
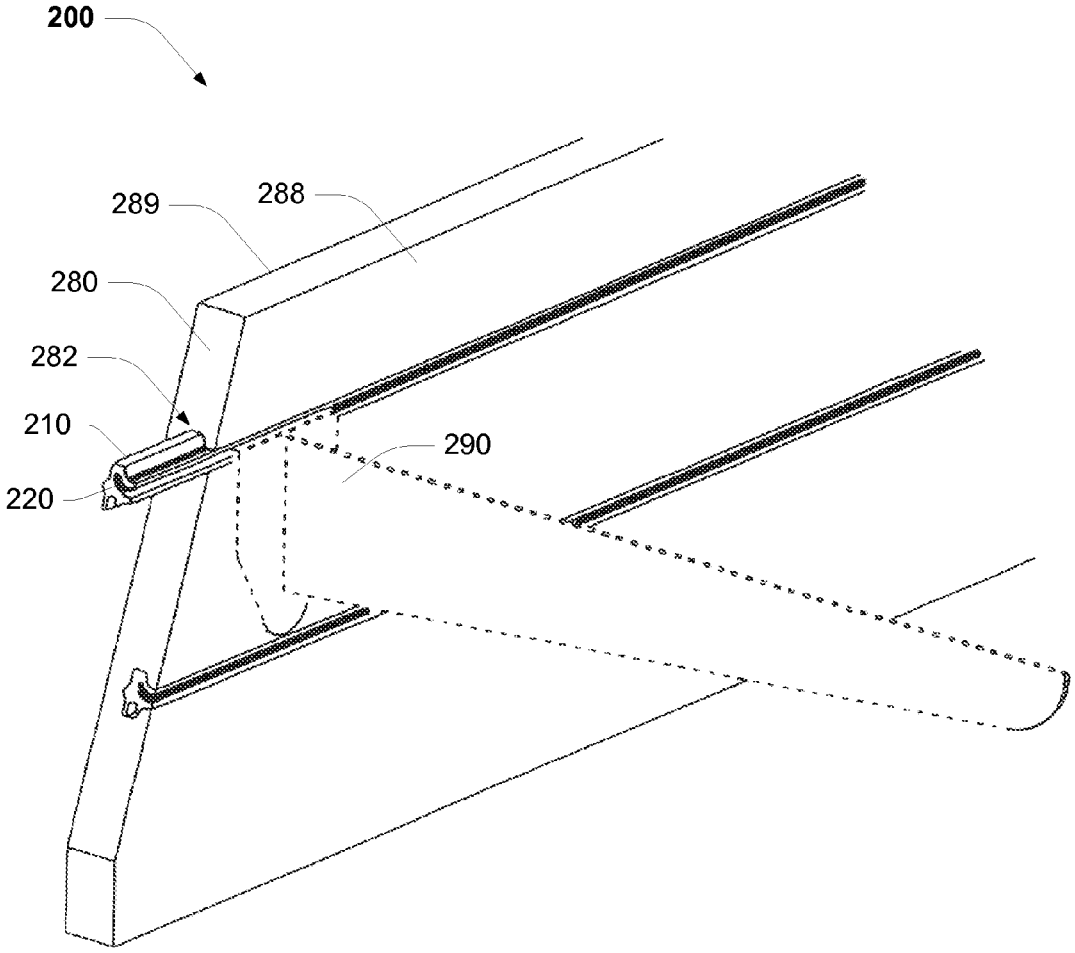
FIG. 18A depicts a wall panel made from wood material, with insert elements designed to receive an anchor portion of a shelving support bracket.
Figure 18B:
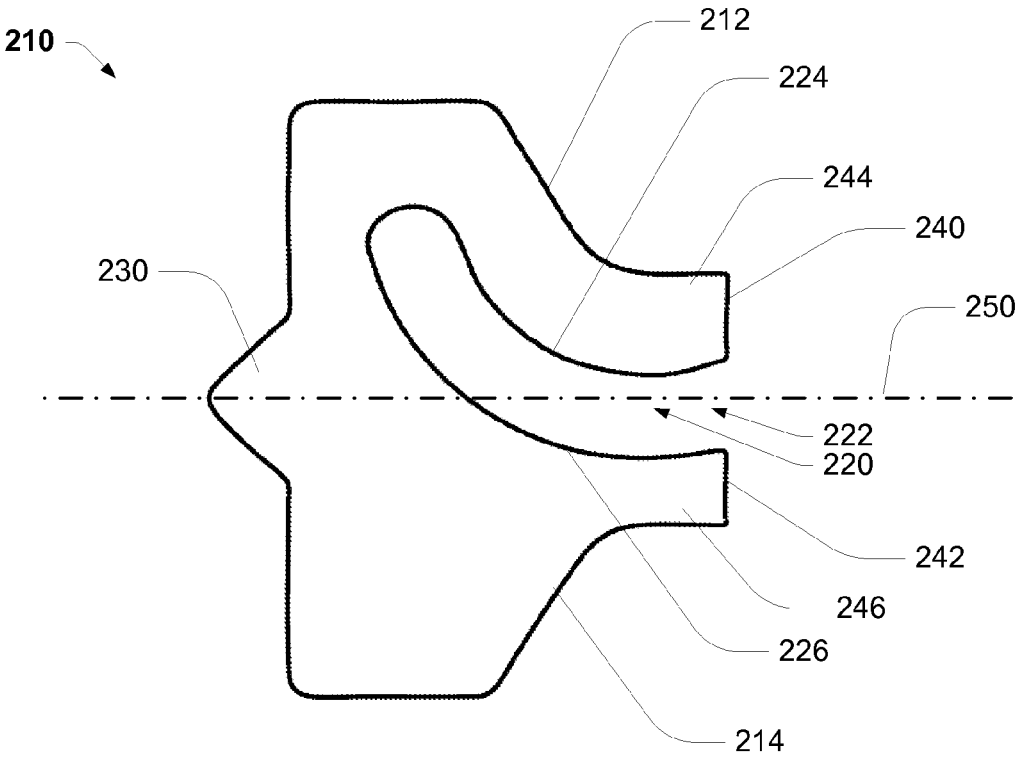
FIG. 18B depicts a end profile view of the insert element of FIG. 18A.
Figure 18C:
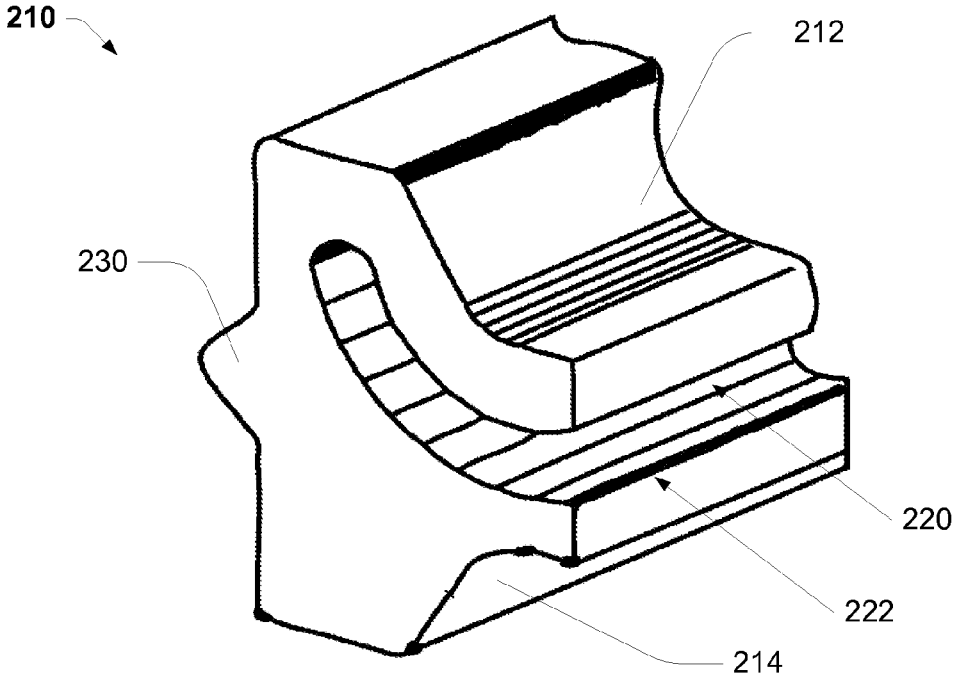
FIG. 18C depicts a partial perspective view of the insert element of FIG. 18A.
Figure 18D:
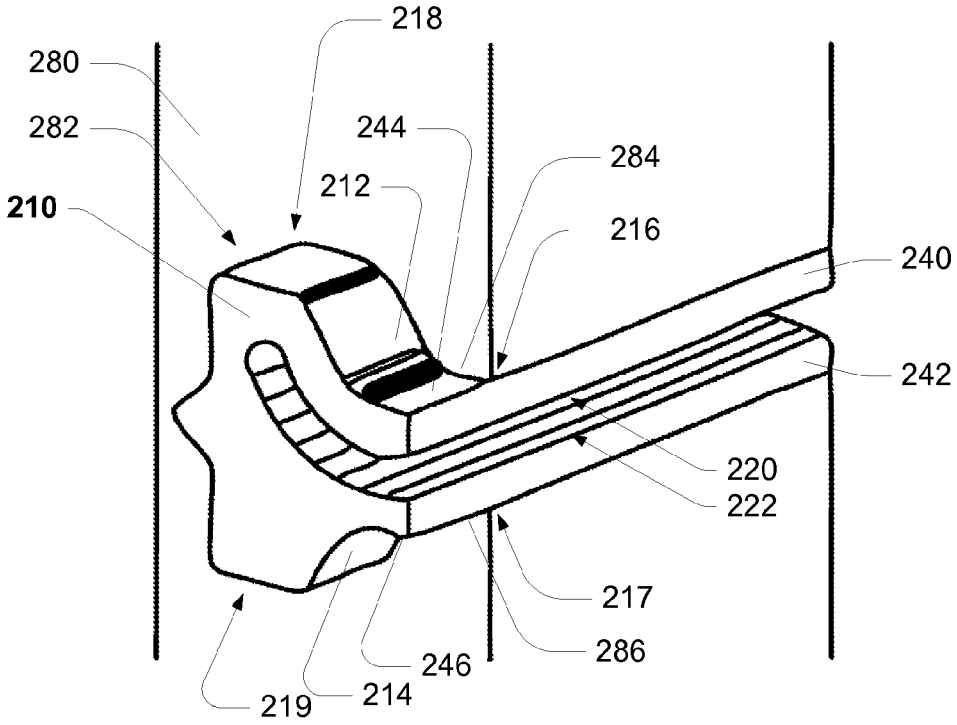
FIG. 18D a partial perspective view of the insert element of FIG. 18A, shown slidably inserted into a wall element.

FIG. 18A through FIG. 18E show an embodiment display mounting apparatus. FIG. 18A depicts a wall panel (typically made from wood material), with insert elements designed to receive an anchor portion of a shelving support bracket. FIG. 18B depicts a end profile view of the insert element of FIG. 18A. FIG. 18C depicts a partial perspective view of the insert element of FIG. 18A. FIG. 18D a partial perspective view of the insert element of FIG. 18A, shown slidably inserted into the wall panel element.

Figure 18E:
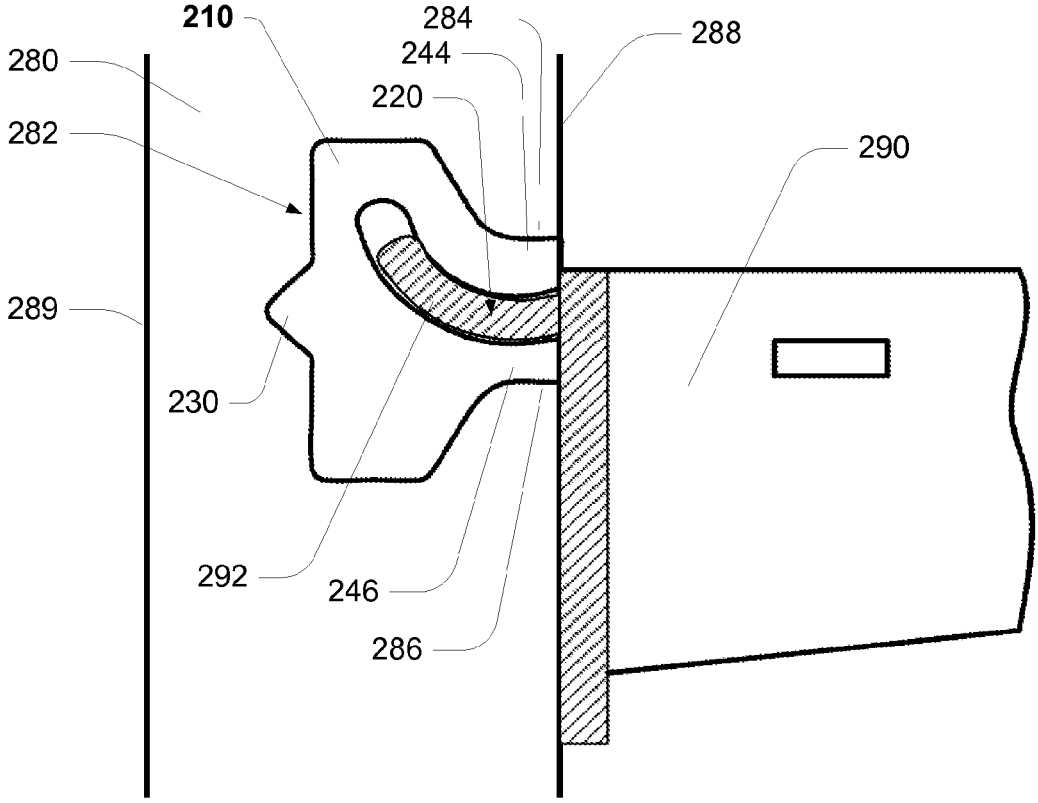
FIG. 18E a side view of the insert element of FIG. 18A, shown slidably inserted into a wall element and engaged to a shelving support bracket.

FIG. 18E a side view of the insert element of FIG. 18A, shown slidably inserted into a wall element and engaged to a shelving support bracket.

An improved shelving bracket mounting system is described for receiving an arcuate anchor portion of a cantilevered arm. A cavity profile for receiving the cantilevered arm, in combination, provides a secure retention of the mount in the cavity and has a very good strength and practical utility.

It will be appreciated that FIG. 18A shows an alternative embodiment display mounting apparatus 200. This embodiment is particularly suitable for applications where aluminium may not provide the optimum aesthetic finish. In this embodiment, an extruded aluminium insert element 210 is placed in an wall panel element 280 (typically made from another material, such as wood). The insert 210 has a female cavity 220 which is adapted to receive the anchor portion of a shelving support bracket 290 (shown in dotted lines).

It will be appreciated that an embodiment display mounting apparatus can facilitate rapid installation of wall panels, while reducing the appearance of screws, bolts or other fastening devices when installed. In particular, a wall panel may have a longitudinal insertion cavity 282 for receiving the insert 210. The insertion cavity 282 being typically created by a router device.

Referring to FIG. 18A through FIG. 18E, a display mounting apparatus 200 can include an anchoring cavity 220 for receiving product display system, for example a shelving bracket 290 or similar items. The shelving brackets or similar items can have a male anchor portion 292 (best shown in FIG. 18E) adapted to be received by the anchoring cavity.

FIG. 18B shows an enlarged end profile view of an embodiment elongate extruded insert element 210 (as also depicted in a pictorial view of FIG. 18C). In this embodiment the elongate insert element 210 defining a female cavity 220 which is adapted to receive the anchor portion (not shown) of a shelving support bracket. The anchor cavity can comprise an internal profile that is congruent with the external profile of the anchor portion. It will be appreciated that there is typically a direct male-female correlation between the profiles of the anchor portion and anchor cavity, i.e. a shape fit.

In an embodiment, by way of example only, the display apparatus includes at least one elongate insert element 210 adapted to be received by a wall panel portion 280, the insert element defines a curved longitudinal anchor cavity 220 having an anterior longitudinal anchor slot 222 for receiving a support bracket with a curved anchor portion (for example, anchor portion 292 as shown in FIG. 18E).

In this example embodiment, the anchor cavity 220 has a substantially constant radius so as to enable relative rotational insertion-engagement of a radiused anchor portion of the support bracket. An upper cavity surface 224 and lower cavity surface 226 define the anchor cavity, and have a common concentric curvature. The upper cavity surface 224 and lower cavity surface 226 have a substantially constant radial separation that is adapted for receiving a substantially constant-thickness radiused anchor-portion of the support bracket.

In this example embodiment, the insert element 210 includes a longitudinal protrusion rib element 230 for increasing torsion rigidity to the insert element and for improving engagement between the wall panel and the insert element. The rib element 230 is typically integrally formed with the insert element 210 when manufactured as an extruded metal element.

In this example embodiment, the insert element 210 defines an upper surface 212 and lower surface 214, each surface extending non-inwardly, or generally outwardly, from an anterior wall engagement 216, 217 to a posterior wall engagement 218, 219 (as best shown in FIG. 18D.

It will be appreciated that this non-inward (or generally outward) progression of each of the upper and lower surfaces as they extend rearward can be generated in the wall panel, at least in part, by a router device or plunge router device.

It will be appreciated that, to facilitate generation of an insert aperture by a router, it is beneficial that the side profile of the elongate insert element is symmetrical about an axis 250 (as shown in FIG. 18B), wherein the upper surface 212 and lower surface 214 each extend non-inwardly (or generally outwardly) from the axis when traversing from the anterior wall engagement 216, 217 to the posterior wall engagement 218, 219.

In this example embodiment, the elongate insert element defines an upper lip region 240 and lower lip region 242, for defining an elongate mouth of the elongated anchor slot 222. Each lip element 240, 242 define a respective protruding lip region 244, 246, such that when assembled, respective anterior abutting portions 284, 286 of the panel adjacent to protruding lip element are sufficiently deep for reducing risk of splitting or breakage of the abutting portions in use. When assembled, each lip element is located substantially flush with the anterior surface of the panel.

FIG. 18A through FIG. 18E show an example embodiment display mounting apparatus 200 for mounting display brackets 290, the display brackets having a male anchor portion 292 having a profile which is an upwardly curved tab of substantially even thickness, the apparatus comprising:

the elongate insert element having a pair of parallel longitudinal anterior lip portions 240, 242 that define an elongate longitudinal orientated slot aperture 222 to a substantially horizontally orientated anchoring cavity 220 for receiving the male anchor portion; the anchor cavity having a profile that substantially conforms to the profile of the male anchor portion.

The anchor cavity 220 is defined by an upper cavity surface 224 and a lower cavity surface 226; upper cavity surface and a lower cavity surface having a common concentric curvature; the anchoring cavity being further adapted to receive the anchor portion having a profile which is a curved tab of substantially even thickness; and the anchoring cavity being of a co-operating substantially uniform width for receiving the curved tab.

The anterior lip portions 240, 242 protrude to define an upper surface 244 and lower surface 246 that is substantially perpendicular to the anterior face. The insert element profile vertically-broadens, from the anterior face toward the posterior face, with respect to the lip portions. The insert element has an exterior profile that is substantially symmetric about a central horizontally orientated plane 250.

The insert element 210 has a substantially rectangular profiled body portion, and a posterior protruding longitudinal rib element 230. The rib element is integrally formed with the insert element. The insert element being a length of extruded aluminium.

The apparatus 200 further comprises a panel 280 having an anterior surface 288 and a posterior surface 289, having one or more insert element 210 being located within the panel. The lip portions of the insert element being in substantial vertical alignment with the anterior surface of the panel. The panel is thereby adapted to receive a male anchor portion via the anchoring cavity located in the anterior surface.

The panel including one or more insertion cavity 282 for slidably inserting each of the respective one or more insertion element. The insert element has an exterior profile that is substantially symmetric about a central horizontally orientated plane 250 such that each insertion cavity can be created by a router tool.

The anterior lip portions 240, 242 protrude to define an upper surface 244 and lower surface 246 that is substantially perpendicular to the anterior face such that an insertion cavity preserves sufficient panel material (284 and 286) about the anterior surface 288 to retain the insert element within the insertion cavity, while resisting breakage of the preserves panel material.

It will be understood by those skilled in the art that the inventive components and system described above may be manufactured from various different materials and in a number of variations in the precise shape of the parts, which will nevertheless fall within the spirit and scope of the invention.

Accordingly, it will be understood that the above embodiment of the present invention have been disclosed by way of example and that other modifications and alterations may occur to those skilled in the art without departing from the scope and spirit of the appended claims.

It will be appreciated that the illustrated embodiments disclose display mounting apparatus.

Although the invention has been described with reference to specific examples, it will be appreciated by those skilled in the art that the invention may be embodied in many other forms.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected", along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical, or that two or more elements are not in direct contact with each other but yet still co-operate or interact with each other.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

As used herein, unless otherwise specified the use of terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader, or with reference to the orientation of the structure during nominal use, as appropriate. Similarly, the terms "inwardly" and "outwardly" generally refer to the orientation of a surface relative to its axis of elongation, or axis of rotation, as appropriate.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

It will be appreciated that an embodiment of the invention can consist essentially of features disclosed herein. Alternatively, an embodiment of the invention can consist of features disclosed herein. The invention illustratively disclosed herein suitably may be practiced in the absence of any element which is not specifically disclosed herein.

The claims defining the invention are as follows:

1. A display apparatus for mounting display brackets, the display brackets having a male anchor portion having a profile which is an upwardly curved arcuate tab of substantially constant thickness, the apparatus comprising:

at least one elongate insert element having an anterior face and a posterior face;

the insert element having an exterior profile that is substantially symmetric about a central horizontally orientated plane; the elongate insert element having a pair of parallel longitudinal anterior lip portions that define an elongate longitudinal orientated slot aperture connected to a substantially horizontally orientated anchoring cavity;

the anchoring cavity being defined by an inwardly-upwardly upper cavity curved surface and an inwardly-upwardly curved lower cavity surface, the upper cavity surface and the lower cavity surface each being arcuate and having a substantially common concentric curvature to define an upwardly curved cavity of substantially constant width for receiving the male anchor portion; the anchor cavity having a profile and a thickness that is adapted to receive the male anchor portion therein;

the insert element having a posterior protruding longitudinal rib element coincident with the central horizontally orientated plane; and the longitudinal rib element has a substantially triangular profile with a posterior protruding apex being coincident with the central horizontally orientated plane.

2. An apparatus according to claim 1, wherein the anterior lip portions protrude to define an upper surface and a lower surface that is substantially perpendicular to the anterior face; and wherein the insert element profile vertically-broadens, from the anterior face toward the posterior face, with respect to the lip portions.

3. An apparatus according to claim 1, wherein the insert element having a substantially rectangular profiled body portion.

4. An apparatus according to claim 1, wherein the insert element being a length of extruded metal.

5. An apparatus according to claim 1, wherein the insert element being a length of extruded aluminium.

6. An apparatus according to claim 1, wherein the insert element having a substantially rectangular profiled body portion;

the anterior lip portions protrude to define an upper surface and a lower surface that is substantially perpendicular to the anterior face; and the upper surface extends in an upward trajectory toward the body portion, and the lower surface extends in a downward trajectory toward the body portion.

7. An apparatus according to claim 6, wherein the insert element being a length of extruded metal.

8. An apparatus according to claim 1, the apparatus further comprising:

a panel having an anterior surface and a posterior surface;

a plurality of the insert elements being located within the panel such that the lip portions are in substantial vertical alignment with the anterior surface of the panel;

wherein, the panel is thereby adapted to receive a male anchor portion via the anchoring cavity of one of the insert elements located in the anterior surface of the panel.

9. An apparatus according to claim 8, wherein:

the panel includes a plurality of insertion cavities, each of the insertion cavities having slidably received a respective one of the insert elements.

10. An apparatus according to claim 9, wherein the anterior lip portions protrude to define an upper surface and a lower surface that is substantially perpendicular to the anterior face such that each insertion cavity preserves sufficient panel material about the anterior surface to retain a respective one of the insert elements within the insertion cavity, while resisting breakage of the preserves panel material.

11. An apparatus according to claim 9, wherein each insertion cavity is created by a router tool.

12. An apparatus according to claim 6, the apparatus further comprising:

a panel having an anterior surface and a posterior surface;

a plurality of the insert elements being located within the panel such that lip portions are in substantial vertical alignment with the anterior surface of the panel wherein, the panel is thereby adapted to receive a male anchor portion via the anchoring cavity of one of the insert elements located in the anterior surface of the panel.

13. An apparatus according to claim 12, wherein:

the panel having a plurality of insertion cavities, each of the insertion cavities being for slidably receiving a respective one of the insert elements.

14. An apparatus according to claim 13, wherein the anterior lip portions protrude to define an upper surface and a lower surface that is substantially perpendicular to the anterior face such that each insertion cavity preserves sufficient panel material about the anterior surface to retain a respective one of the insert elements within the insertion cavity, while resisting breakage of the preserves panel material.

15. An apparatus according to claim 14, wherein each insertion cavity is created by a router tool.

* * * * *